United States Patent [19]

Endrody

[11] Patent Number: 4,979,750

[45] Date of Patent: Dec. 25, 1990

[54] TRADING PROPERTY CARD GAME WITH GROUPING VALUED SCORE CARDS AND MARKERS

[76] Inventor: Eugene Endrody, 509 - 825 Granville St., Vancouver, B.C. V6Z 1K9, Canada

[21] Appl. No.: 465,333

[22] Filed: Jan. 16, 1990

[51] Int. Cl.[5] ..... A63F 1/04

[52] U.S. Cl. ..... 273/297

[58] Field of Search ..... 273/269, 278, 297

[56] References Cited

U.S. PATENT DOCUMENTS 1,460,966 7/1923 Johnson ..... 273/297

4,913,446 4/1990 Winkelman ..... 273/278

*Primary Examiner*—Edward M. Coven

*Assistant Examiner*—Raleigh W. Chin

[57] ABSTRACT

This invention relates to card games in which cards are traded and in which scores that depend on the combination of cards held by a player are tallied by means of score cards and markers. The score cards have charts with values and cross-reference multipliers by which the value of each of a player's card's is determined by references to other related cards that he may possess. The cards are traded by a system of offers and acceptances, credits and debts. The current state of a player's hand of cards is tracked by markers located on squares of each player's score card corresponding to the particular cards held. The value of the combination of his current cards, and of possible combinations that he may be able to acquire by trading, are calculated by the player consulting his score card. The markers and the score cards are preferably magnetically engagable, in order to allow the score cards to function properly when held up by the player in a position that conceals the player's combination from the other players. The cards can be made to represent commodities, industries, real estate holdings, or any other property that might be traded in the real world and that might have differing values depending on the collateral property held by the owner.

5 Claims, 1 Drawing Sheet

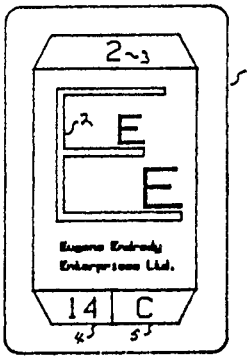
FIG. 1
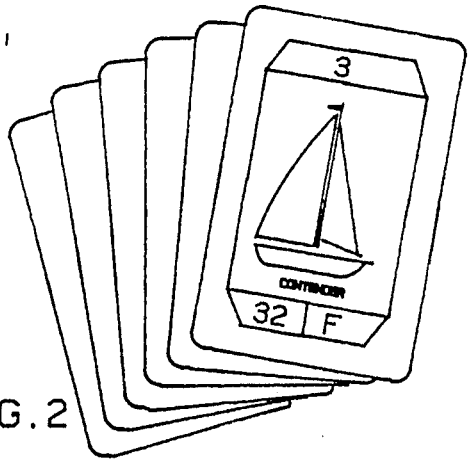
FIG. 2
FIG. 3
| | | | | | | | |
|---|---|---|---|---|---|---|---|
| A | 1<br>01 | 1<br>02 | 4<br>03 | 1<br>04 | 3<br>05 | 2<br>06 | |
| B | 2<br>07 | 3<br>08 | 1<br>09 | 3<br>10 | 1<br>11 | 2<br>12 | |
| C | 1<br>13 | 2<br>14 | 1<br>15 | 2<br>16 | 5<br>17 | 1<br>18 | |
| D | 2<br>19 | 4<br>20 | 1<br>21 | 3<br>22 | 1<br>23 | 1<br>24 | |
| E | 2<br>25 | 1<br>26 | 2<br>27 | 1<br>28 | 2<br>29 | 4<br>30 | |
| F | 1<br>31 | 3<br>32 | 1<br>33 | 2<br>34 | 3<br>35 | 2<br>36 | |
| G | 5<br>37 | 1<br>38 | 1<br>39 | 2<br>40 | 1<br>41 | 2<br>42 | |
| H | 1<br>43 | 1<br>44 | 3<br>45 | 1<br>46 | 2<br>47 | 4<br>48 | |

TRADING PROPERTY CARD GAME WITH GROUPING VALUED SCORE CARDS AND MARKERS

FIELD OF THE INVENTION

The present invention relates to trading card games, and in particular discloses such a game, in which scores that depend on the combination of cards held by a player are tallied by means of score cards and markers.

DESCRIPTION OF THE PRIOR TECHNOLOGY

There are a number of games played with an ordinary 52-card deck in which cards are traded and the value of each player's hand depends upon the grouping of his individual cards according to pre-determined parameters. A specialty trading card game, in which the cards represent commodities, has been sold under the trademark "Pit", by Parker Brothers. The "Monopoly" real estate trading game makes use not only of property cards, but also of rent charts that show the value of certain combinations of property. U.S. Pat. No. 4,569,526 shows a complicated stock exchange game, in which the value of pieces representing securities changes with each player's placement and moving of the pieces into combinations and positions relative to other players' pieces on a game board.

While the above-noted games make use of principles that are related to the presently disclosed invention, none of the prior technology discloses the features that together make up this invention.

SUMMARY OF THE PRESENT INVENTION

This invention provides a trading card game, in which score cards are used that have charts with positions corresponding to the trading cards. Multipliers are used in calculating the value of a player's trading cards, depending on the grouping of the corresponding positions on his score card. The acquisition of adjacent positions is valued. The trading cards represent commodities, industries, real estate holdings, or any other property that might be traded in the real world and that might have differing values depending on the collateral property held by the owner. A preferred version of the game would be a "yuppie" version, in which the properties are items recognized as status symbols and coveted by young urban professionals, among others.

The trading cards are traded by system of offers and acceptances, credits and debts. The current state of a player's hand of cards is tracked by markers located on squares of each player's score card corresponding to the particular cards held. The value of the combination of his current cards, and of possible combinations that he may be able to acquire by trading, are calculated by the player consulting his score card.

The markers and the score cards are preferably magnetically engagable, in order to allow the score cards to function properly when held up by the player in a position that conceals the player's combination from the other players.

The face of each card should have a picture or logo signifying the property that the card represents. The backs of the cards should be nondescript, in order to allow variations involving secrecy as to a player's holdings at various stages of the game.

The face of each trading card is marked with its value, and the value is also marked on the position corresponding to that card on each of the score cards.

In a preferred embodiment, there would be a deck of forty-eight trading cards. Six cards would be dealt to each of seven or eight players, or eight cards to each in the case of six or fewer players, any remaining trading cards out of the total of the trading cards being then left in the deck. Alternatively, the remaining cards could be auctioned to the players by a banker-player prior to trading among the players. As a further alternative, a number of categories of properties could be eliminated by removal of trading cards from the game prior to its inception, such that a pre-selected number of trading cards can be dealt to each player without leaving any trading cards in the deck.

The offering of one or more cards for sale should be done by the players taking turns in rotation. Alternatively, a livelier game could be made by having the trading done simultaneously amongst all the players.

The value of an individual trading card will usually be less than the amount asked for and accepted in the trading, because of the premium placed on groupings of the cards. Because of the differing and changing intentions of the players as to the groupings desired to be acquired, each particular trading card will usually be subjectively valued differently among the players. Money can be borrowed and lent among the player's, and the trading cards can be mortgaged to the banker for their face value.

Play money can be used to finance a player's acquisitions, with a set amount being distributed to each player at the start of the game. Alternatively, the banker could keep a ledger of the players' cash transactions and balances.

A player's net worth is determined by the aggregate value of his trading cards held, plus his cash, less any liabilities he may have. At the end of the game, the player with the highest net worth is the winner.

The game ends when a complete category, as set out on the score card, of properties as represented by the trading cards, is acquired by a player. Alternatively, the rules could be changed to have the game end when a set aggregate value of holdings has been achieved by a player. As a further option, the game could be played to a certain time limit.

DESCRIPTION OF THE DRAWINGS

FIG. 1 is a front view of a sample trading card from a preferred embodiment of this invention.

FIG. 2 is a front view of a hand of six trading cards from a preferred embodiment of this invention.

FIG. 3 is a front view of a score card with magnetic markers in positions corresponding to a hand of trading cards.

DETAILED DESCRIPTION

Referring to FIG. 1, trading card 1 is marked with the logo 2 of the company that the card represents. It is also marked with a face value 3, and with coordinate numbers 4 and 5 for finding the position of that particular trading card on the score card. Each player has his own score card. There is only one trading card corresponding to each of the positions on the score card.

Referring to FIG. 3, the score card 11 is marked with a number of categories (A, B, C, D, E, F, G, and H) and is marked with a position for each trading card in the game. Magnets 11, 12, 13, 14, 15, and 16 are used to engage the metal score card to mark the positions held. A column 19 for unused magnets 17 and 18 is provided. A preferred method of scoring is to multiply the sum of the values of the individual trading cards held by a player times the number of such cards that form a group of adjacent positions on each row of the score card. If the group extends up, down, or diagonally to a part of an adjacent row as well, then the total value of all cards in the group is multiplied by the number of cards forming the extended group. The resulting total is added to the row scoring for the group explained above. For example, the group marked in FIG. 3 would be scored as follows:

| | | |
|---|---|---|
| (a) (2 + 1 + 2 + 1) | × 4 in row E | = 24 |
| (b) (3 + 1) | × 2 in row F | = 8 |
| (c) (2 + 1 + 2 + 1 + 3 + 1) | × 6 in extended group | = 60 |
| | Total: | 92 |

These formulae apply for each such group held by the player, and his group values are totaled in computing his net worth.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method of playing a game adapted to be played with:

(a) a number of trading cards marked with indicia of various properties represented by the trading cards;

(b) score cards with charts of positions representative of the trading cards;

(c) marker means adapted to be placed on the particular positions on a player's score card that correspond to the particular trading cards held by the player;

in which the trading cards are traded among the players of the game by means of a series of offers and acceptances, and in which the value of a player's trading cards is scored by multiplying the value of his trading cards by a factor depending on the grouping of the corresponding marker means on adjacent positions on the score card.

2. The method of claim 1, in which the game ends when a complete category, as set out on the score card, of properties as represented by the trading cards, is acquired by a player.

3. The method of claim 2, in which a pre-selected number of trading cards are dealt to each of a quorum of players, the quorum being between three and eight, any remaining trading cards out of the total of the trading cards being then auctioned to the players by a banker-player prior to trading among the players, and in which the markers are magnetically attached and detached to the score cards to represent the particular trading cards held by the players respectively.

4. The method of claim 1, in which a pre-selected number of trading cards are dealt to each of up to eight players, any remaining trading cards out of the total of the trading cards being then auctioned to the players by a banker-player prior to trading among the players.

5. The method of claim 1, in which a number of categories of properties are eliminated by removal of trading cards from the game prior to its inception, such that a pre-selected number of trading cards can be dealt to each player without leaving any trading cards in the deck.

* * * * *